US005848504A

United States Patent [19]

Guerinet et al.

[11] Patent Number: 5,848,504

[45] Date of Patent: Dec. 15, 1998

[54] INDUSTRIAL FLOOR COMPRISING A NON-ADHERING WEAR LAYER ON A CONCRETE BASE

[75] Inventors: Jean-Paul Guerinet, Compiegne; Hervé Nouailhetas, Charenton-Le-Pont, both of France

[73] Assignee: Lafarge Materiaux de Specialites, France

[21] Appl. No.: 693,334

[22] PCT Filed: Feb. 15, 1995

[86] PCT No.: PCT/FR95/00182

§ 371 Date: Oct. 9, 1996

§ 102(e) Date: Oct. 9, 1996

[87] PCT Pub. No.: WO95/22671

PCT Pub. Date: Aug. 24, 1995

[30] Foreign Application Priority Data

Feb. 16, 1994 [FR] France ..... 94 02011

[51] Int. Cl.[6] ..... E04F 15/12

[52] U.S. Cl. ..... 52/177; 52/327

[58] Field of Search ..... 52/177, 327

[56] References Cited

U.S. PATENT DOCUMENTS 3,024,711 3/1962 Madison ..... 52/177 X 4,924,645 5/1990 Abeln ..... 52/177

5,564,251 10/1996 Van Bers ..... 52/177 X

FOREIGN PATENT DOCUMENTS 2 185 046 7/1987 United Kingdom .

OTHER PUBLICATIONS

Laid–open No. 159476/1988, Laid–open Date: Jul. 2, 1988, Application No. 307501/1986 of Pola Kasei Kogyo Co., Ltd. and Teikoku Kako Co., Ltd.

*Primary Examiner*—Christopher Kent

*Attorney, Agent, or Firm*—Millen, White, Zelano, & Branigan, P.C.

[57] ABSTRACT

An industrial floor, comprising at least one covering layer on a new or existing concrete base, said covering being not bound to the concrete base and obtained from a composition based on at least one hydraulic binder, said floor further comprising, between the concrete base and the covering layer, from the upper face of the concrete base: (a) a smoothing layer enabling the flatness/roughness of said upper face to be less than 2 mm under a 2 meter rule; (b) on the smoothing layer, at least one separating layer for preventing the first covering layer from adhering to the smoothing layer on the base; (c) on the separating layer, at least one covering layer having a maximum of 30 mm.

22 Claims, No Drawings

INDUSTRIAL FLOOR COMPRISING A NON-ADHERING WEAR LAYER ON A CONCRETE BASE

FIELD OF THE INVENTION

The invention relates to an improved industrial floor composed of at least two layers:

a concrete first layer, hereafter referred to as the "concrete base", in which a shrinkage phenomenon may manifest itself or be manifested at the time of setting or hardening;

and at least one other layer, referred to hereafter as the "wear or covering layer", which is not bound to the concrete base. This second layer may preferably be obtained from a composition based on at least one hydraulic binder and/or at least one organic binder.

BACKGROUND OF THE INVENTION

The invention further relates to a method for the production of such an improved floor.

The expression "industrial floor" is intended to mean a sheltered floor supporting all the economic activity of industrial buildings with widely varied activities, excluding so-called pedestrian floors: factories, warehouses, workshops, laboratories, partially sheltered unloading bays, station platforms, etc. The industrial floor is then intended to receive high static and dynamic loads.

Whereas the covering is directly in contact with the external mechanical stresses, it is the role of the concrete base to receive them, transmit them or distribute them in the floor so that the covering is not degraded rapidly and the industrial floor does not require excessively frequent renovations.

Owing to technical advances, the external stresses to which industrial floors are subjected are becoming more and more important: in this regard, mention may be made of the heavy traffic of transporters, high-level storage, etc.

In parallel with this technical advance, there is an increasing requirement for an industrial floor to remain constantly flat and to keep a smooth non-slippery surface (that is to say one which does not contain holes, projections, cracks or other obstacles), in order:

to allow unimpeded and completely safe movement of people and machines, in particular transporters, and consequently in order not to cause industrial accidents;

to be comfortable and aesthetic, or have a decorative appearance, and to be easy to maintain in order to improve the working environment;

to limit the repair work which may lead to business being interrupted.

This is why there is a particular requirement for industrial floors to fulfil at least all of the following mechanical characteristics:

a response to traffic which is sufficient to withstand the movement of the machines as well as their weight;

resistance to puncturing under the effect of heavy loads through reduced surface areas such as a storage structure, etc.;

compressive and flexural/tensile strengths to withstand heavy loads;

impact resistance which is sufficient to withstand, without bursting or cracking, predictable quantified impacts during the design of the floor, of the type involving the sudden depositing of heavy components, falling objects, etc.;

and, where appropriate, a response to thermal stresses resulting from the working temperature (for example the risk of the industrial floor freezing) or thermal variations which it may undergo.

Furthermore, essentially for economic reasons, the choice of a type of industrial floor is determined according to the production time (in the case in point, preparing or making the concrete base, making the covering and the time required before commissioning), location and climatic conditions, etc.

To satisfy these requirements, a covering in the form of an incorporated screed (i.e. a wear layer fitted on fresh concrete) or an attached screed (i.e. a wear layer fitted on hardened concrete) is most often provided on the concrete bases.

More particularly, in the case of an attached screed, the upper layer of the concrete base is provided with surface roughness and, if necessary, is covered with a product in order to make an adhesion bridge between the base and the covering.

However, these industrial floors in which the covering adheres to the concrete base must, for the most part, include a large and sufficient number of joints, or else there is a considerable risk of random cracks occurring on the visible surface of the floor. In fact, these joints essentially serve to compensate for the phenomena of differential expansion between the covering and the concrete, to isolate a part of the floor (in particular around posts and machine bases) in order to allow vertical movements of any origin and to compensate for the phenomena of shrinkage of the concrete when it sets.

Thus, concrete is a material whose volume decreases when it sets and hardens —this is a shrinkage phenomena. Shrinkage is measured in microns per meter: for ordinary concretes, it may exceed 1000 microns per meter.

The consequence of shrinkage is the almost inevitable occurrence of cracks in the concrete. Furthermore, because of their large linear dimensions, poured concrete bases lead to shrinkages which are large in terms of absolute value.

Tackling the deep-rooted causes of the occurrence of shrinkage phenomena is not always industrially feasible, because there are many such causes and, although some of them are fairly well known, others are still poorly understood.

All these shrinkage phenomena, and therefore the occurrence of cracks in the concrete during or after the end of setting, give rise, depending on the extent of the cracks, to often expensive repairs and an unaesthetic appearance.

As indicated above, in view of the fact that it is not possible to avoid shrinkage under economically acceptable conditions, attempts are made to channel it and control it so that its detrimental effects are minimized.

Thus, in order to channel and control the cracking due to shrinkage, as soon as the concrete has sufficient consistency, the following:

"le Bulletin du ciment" [cement bulletin] No. 5, May 1990 (chapter entitled "Screed—floor covering structures, cement-based screed. Instructions for design and implementation");

and "le Document Technique Unifié(D.T.U.) [Unified Technical document] of September 1982 (volume 1794, No. 26.2, entitled "Screed and slabs based on hydraulic binders);

recommend cutting out the shrinkage joints, which are made:

every 25 $m^2$ and at most every 8 m if the surface is intended to remain uncovered or to receive a film of paint;

every 50 $m^2$ and at most every 10 m in other cases.

In practice, the person skilled in the art knows that he should provide shrinkage, expansion and isolation joints:

at most every 5 m, in order to limit random cracking phenomena;

and in all regions where tensile stress concentrations may lead to random cracking, such as, for example, thickness discontinuities or interruptions in the continuity of the surface owing to the presence of a pillar, a window, a door or a projecting corner.

In fact, as mentioned above, further to their use with regard to shrinkage phenomena, joints are conventionally arranged in large-area industrial floors in order to limit the occurrence of shear stresses resulting from the differential expansions between the concrete base and the covering. These expansions are generally due either to thermal and hygrometric variations or to mechanical deformations caused by the forces to which the industrial floor is subjected, in particular when it is loaded.

Conventionally, the joints are made as soon as possible, most often by mechanical sawing.

The effect of cutting out the joints is to create a weak section in the concrete which will therefore crack preferentially. The other desired effect is the straight, sharp appearance of the surface crack, which allows it to be treated using various known methods: sections, filling coatings, etc.

A well-known technique for decreasing or even eliminating the propagation of cracks from the concrete base to the covering consists in providing an intermediate layer between them in order to make the covering not adhere to the concrete base. In such a case, the covering (or wear screed) is referred to as "floating".

The main problem resulting from this technique resides in the poor mechanical performance of "floating" coverings. In fact, under the effect of loads of the type encountered in industrial activity, such as transporter traffic, this type of covering is highly susceptible to cracking.

One solution to this problem could be to provide thick coverings (at least 5–6 cm), but this is equivalent to forming a new slab with mechanical characteristics similar to those of the concrete base. The latter solution is not satisfactory, on the one hand, for economic reasons and, on the other hand, because of the raise in the final level of the floor which results therefrom. This is why the use of a floating screed is usually reserved for the production of residential or pedestrian floors, that is to say floors intended to be subjected to moderate-to-low intensity external stresses.

The object of the present invention is to overcome all the abovementioned drawbacks of known techniques for producing floors, in the case of industrial floors. More particularly, the invention aims to reduce or even eliminate the occurrence of random cracks at the surface of floor, these cracks possibly resulting from normal and high-intensity mechnical-type stresses encountered in an industrial environment and/or because the base, prepared using a concrete, can exhibit a shrinkage phenomena and subsequently dimensional variations different from those of the covering.

The invention also aims to limit the number of joints necessary for a floor not to crack, or even eliminate them, in particular in the following cases:

floors located in buildings subjected to low hygrometric and/or thermal variations;

floors supporting little or no concentrated loading, such as car parks;

floors having little or no discontinuity, such as posts, windows, etc.

To this end, the invention proposes an improved floor for industrial use, comprising at least one covering layer on a new or existing concrete base, characterized in that the covering is not bound to the concrete base and in that the upper face of the concrete base is treated successively in the following way:

a) smoothing this upper face so that its flatness/roughness is less than 2 mm under a 2 meter rule (under the conditions of D.T.U. 26-2 but with different requirements), it being possible to obtain this smoothing by mechanical floating, but preferably by applying at least one layer of a self-smoothing product (hereafter referred to as the smoothing layer), it being furthermore necessary for this smoothing layer to adhere to the concrete base;

b) depositing at least one means for preventing the first covering layer from adhering to the smoothed surface (hereafter referred to as the "separating means");

c) depositing one (or more) covering layer (or layers) which is reinforced over the entire area to be treated which is poured over the separating means, the thickness of this coating being a maximum of 30 mm.

In contrast to the techniques conventionally used for producing industrial floors, the Applicant recommends separation (i.e. non-adhering) of the covering from the concrete base after smoothing of its upper face, preferably with the aid of a self-smoothing product which adheres to the concrete.

It has in fact been found that the great propensity of floating coverings (or screed) to crack under the effect essentially of the mechanical stresses encountered in an industrial activity did not result only from the possible weakness of the floating covering at the cracks in the concrete base, but above all from the irregularity of the contact surface between the base and its covering, and consequently as a result of the fact that either the covering does not bear completely on the support or these irregularities cause localized tensile stress concentrations which initiate cracks in the covering.

Thanks to the invention, the upper surface of the concrete base is improved, and therefore the regularity of the contacts between the base and the covering. As a result of this, it has been observed that the covering can then received and distribute the mechanical stresses to which it is subjected, and effectively oppose the occurrence of random cracks and various deformations on the visible face of the industrial floor.

As indicated above, the invention relates both to the production of a floor from an existing and renovated concrete base, and to that of a new concrete base. For the sake of simplicity, the term "new floor" will be used to denote a floor which has a new base, as opposed to a "renovated floor" which has a renovated base.

In its usual form, the invention does not obviate the production of the concrete base while respecting the rules of the art, in particular as regards the production of segmenting joints, in particular respecting the maximum distance between joints and sawing within the time limits.

According to an advantageous embodiment of the invention, applicable only to a new floor, one or more sections chosen from a material which adheres little or not at all to concrete are arranged on the foundations. The said sections, by reducing the cross-section of the concrete base at the sections, make it possible to induce substantially vertical cracking at each inducer if the tensile stresses in the concrete resulting from the shrinkage are sufficient. Then the concrete is poured over the foundations and the said sections, in order to form the concrete base.

This advantageous embodiment of the invention makes it possible to make the distribution of the induced cracks due to the shrinkage of the concrete more dense and to distribute them better over the surfaces. It is then conceivable to increase significantly the distances between the joints cut out from the concrete base, or even eliminate them completely, because it is thus possible to guarantee good mechanical performance of the covering plumb with the induced cracks, on the one hand by the presence of the reinforcement, and on the other hand by the control of the width of the induced cracks, which is limited in this case.

DETAILED DESCRIPTION OF THE INVENTION

The precise composition of the concrete of which the base is made is not critical. However, it will be clearly understood that the invention is useful when the nature of the concrete, the working and climatic conditions during manufacture of the floor and the conditions under which the floor is used make the occurrence of shrinkage phenomena and dimensional variations in this layer become critical.

The invention is particularly well-suited to standardized concrete compositions in which, essentially, at least one hydraulic binder, granulates in proportions which are well-dosed according to the rules of the art, and various inorganic or organic adjuvants are found.

The proposed invention does not obviate adherence to the traditional rules of the art, as regards concrete manufacture and implementation. Thus, it is recommended to respect the concrete manufacture standards, in particular as regards water/cement ratios, concrete grading distribution curves, granulate shape coefficients, mixing times and temperature.

It is furthermore strongly recommended, in the case of an industrial floor, to choose a concrete composition which allows the base to achieve both:

- a compressive strength of the order of 10 MPa or more, preferably at least equal to 20 MPa (according to EN Standard 196-1 of March 1990), and
- a flexural/tensile strength at least of the order of 2.2 MPa or more, preferably at least equal to 2.5 MPa;
- a good surface condition (little roughness, absence of chalking) so that the tear resistance of the base is of the order of 1–1.5 MPa, or even at best of the order of 2 MPa.

In the case of a new floor containing one or more sections (refer to the aforementioned advantageous embodiment of the invention), the presence of the sections allows favourable distribution of the cracks over the entire area of the floor. This is why, in this case, it is easier to use concrete compositions incorporating setting and hardening accelerator compounds, which tend to enhance the shrinkage phenomena.

According to an advantageous variant of the invention, the upper face of the concrete base is first of all covered with a smoothing layer in order to overcome the well-known difficulty of smoothing with the desired precision using mechanical means.

To form the smoothing layer, use is made of a composition made of a material which can both form a smooth surface and adhere to the concrete base. It is furthermore recommended to provide a composition which, once hardened, makes it possible to obtain a minimum compressive strength of the order of 10 MPa, preferably at least equal to 20 MPa. Still more preferably, a conventional self-smoothing cementing composition is chosen. Normally, a 3 mm thickness for the smoothing layer is sufficient to obtain correct smoothing. Greater thicknesses may be necessary for smoothing very rough concretes.

If necessary, in order to complete the smooth appearance of the upper surface of the smoothing layer, before pouring the self-smoothing product, a layer is deposited in order to improve the adherence and control the porosity of the surface of the base using an impregnation product which also serves as a sealing filler and is referred to by specialists by the terms "bonding primer" or "adhesion primer". This impregnation product also makes it possible to prevent the appearance of surface chalking. The impregnation product most often used is a composition in the aqueous phase or of an allowed solvent of a resin (homo-, co- or even terpolymer) which may be a vinyl acetate, a versatate, an ethylenic derivative, an epoxy, a polyurethane, a neoprene, a styrene-butadiene, a styrene-acrylic, etc.

According to another important characteristic of the invention, once the desired smoothing has been obtained, the following are successively deposited on the new or renovated concrete base:

1. one (or more) separating means for making the wear layer (or covering) not adhere to, depending on the case, the smoothed surface of the base or the smoothing layer. In this way, the covering undergoes virtually no tensile stresses due to the dimensional variations which may occur in the base, regardless of their causes (cracks, hygrometric and/or thermal variations, strong external stresses). The reduction in friction with the base is furthermore made possible by virtue of the absence of retention points on the base, the upper face of which has been made smooth, preferably thanks to the smoothing layer. The separating means used are preferably products which either do not adhere to the smoothing layer or do not adhere to the wear layer, or else do not adhere to either of these two layers. Suitable separation products are paraffins, silicones, petroleum-based waxes, stearates such as magnesium stearates and any other product, generally essentially organic. The thickness of the layer formed with the single or multiple separating means is designed to ensure that the covering does not adhere to the smoothing layer: it is recommended to provide a thickness of the order of 100 $\mu$m to 200 $\mu$m. It is possible to use greater thicknesses, for example 3 mm or more, on condition that the material used withstands, without deforming, the pressure of the screed in use. As soon as the smoothing layer can support an operator and the machines useful for manufacturing the floor, without impairing the smoothing, the anti-adhesion products may be applied thereto manually or mechanically (for example by spraying). Further separating means which may be used are thin films of non-adhesive products, for example films made with polyolefins such as polyethylene or any other materials which can be deposited over large areas on the smoothed base, on condition that they do not adhere to the smoothed base or to the covering. However, when it is in the form of a thin film, the separating means must be deposited with great caution so as not to create surface irregularities such as folds or air pockets, and thereby lead to an irregular surface appearance and impair the perfect application of the covering onto the base. This is why it is recommended to stretch it and adhesively bond it onto the smoothing layer.
2. one or more covering layers which are poured onto the separating means. In practice, the separating means is firstly covered with a reinforcement, then the coating is poured on top to form the reinforced covering. The main selection criterion for the reinforcement resides in its capacity to give a good distribution of the tensile stresses which result from the stresses to which the covering is subjected. Furthermore, so that the covering layer benefits fully from the technical effects provided by the reinforcement, the latter is advantageously laid on means making it possible to raise the reinforcement, partly or fully, above the separation layer, these means optionally forming an integral part of the reinforcement. In this way, the armature is fully embedded in the mass of the layer forming the covering. The reinforcement is generally in the form of a lattice and may be made of any material which is compatible with the materials of the floor, so long as it has sufficient tensile strength. By way of example, mention may be made of metal or treated glass-fibre grills, which may be in the form of large plates or wide strips.

If the covering is composed of a plurality of superposed layers, the reinforcement is integrated in the thickest layer.

The format and the size of the meshes defined by the lattice-shaped reinforcement may also vary. They often depend on the type of material forming the reinforcement, as a result of the manufacturing techniques.

However, care will be taken that the dimensions of the meshes of the reinforcement are greater than the dimensions of the particles and/or fibres contained by the covering composition, in order to avoid a sieving effect with regard to this composition.

Finally, the choice of the density of the meshes and of the material of the reinforcement is, of course, dependent on the level of tensile strength which it is desired to develop for the reinforcement.

Once the reinforcement is laid, the last step for forming the floor according to the invention consists in pouring one or more layers to form the covering. It is recommended to provide a thickness at least equal to 10 mm for the covering, since with a smaller thickness there is a risk that the mechanical flexural strength of the industrial floor may be insufficient. The thickness of the covering layer may be up to 30 mm, as previously indicated. However, essentially for economic reasons, it will be preferable to adopt a thickness of the order of 15 mm. It will be noted that the invention permits a considerable reduction in the thickness of those screed, when it is compared with the known conventionally, which are typically 50 mm to avoid cracking.

A major benefit of the invention is that the precise composition of the covering layer is not critical. This composition is essentially chosen in accordance with the characteristics which it is desired to give the covering layer (in particular minimum shrinkage) and the use which will be made of the finished floor.

Nevertheless, it is preferable to use covering layer compositions comprising at least one hydraulic binder and at least one organic binder, since under these conditions the method according to the invention has proved to be very effective (absence of cracking on the upper surface of the pavement).

After this last step, as soon as the covering is sufficiently hardened, a multilayer floor is obtained which can be used as it is or optionally covered with one or more finishing layers.

According to another advantageous alternative embodiment of the invention indicated above, the known principle of crack direction is retained, but with an important modification: the cracking is induced via the bottom of the floor using sections, and it is directed upwards, in a substantially vertical plane, in line with the sections, in contrast to the cutting out of shrinkage joints, the induction of which takes place from the base towards the bottom of the pavement. The concrete base is thus weakened by reducing its cross-section in line with the sections: therefore, if the tensile stresses resulting from the shrinkage are sufficient, the cracking will take place precisely in line with the sections.

Then, according to the invention:

the surface of the concrete is smoothed as soon as it has reached sufficient strength to withstand light loads such as the weight of one or more operators, preferably before the occurrence of induced cracking, and more preferably with the aid of at least one smoothing layer;

next, at least one separating means, a reinforcement in the form of a lattice and at least one layer for forming the covering are deposited in succession.

The concrete base is advantageously weakened so that to form induced cracking in line with most or all of the sections, and thus to prevent the formation of wide infrequent cracks.

To do this, the sections are preferably spaced apart from one another by a distance ranging from approximately 1 meter to 10 meters. More preferably, the provisions of the D.T.U. of September 1982 (which are specified above) are followed, which leads to arrangement of the sections at least every 5 meters, so that they define areas of no greater than 25 $m^2$.

Furthermore, care is taken to arrange the sections in all regions where tensile stress concentrations may lead to undesirable cracking, such as, for example, thickness discontinuities or interruptions in the continuity of the surface due to the presence of a pillar, a window, a door or a projecting corner.

Despite the probable occurrence of cracks in the base because of the shrinkage, the Applicant Company has observed the absence of occurrence of visible cracks at the surface of the covering. This shows that the separation of the covering from the smoothed base allows the covering not to crack when it bears on a smooth base having cracks of limited width.

The sections must be made of a material which adheres little or not at all to concrete, this being in order to minimize the bonding of the concrete to the sections. They must furthermore be sufficiently rigid. By way of examples of materials which can be used for manufacturing sections, mention may be made of plastics such as polyethylene or polypropylene, which are perfectly suitable so long as they are sufficiently rigid to support the concrete base without deforming. They may also be wooden.

The format of these sections may vary. They are preferably chosen with a height of at least one sixth of the height intended for the concrete base, so that they indeed reduce the area of its cross-section by at least one sixth. More preferably, the height of the sections is at least equal to one third of the height of the base. The best results as regards the aesthetics of new floors according to the invention were obtained when the height of the sections is at least equal to one half of the height of the base.

The other aspects of the format are not critical, and are intended only to facilitate laying and/or fastening on the foundations of the floor, transport or else lengthwise division in order to adjust the dimensions.

According to a first advantageous variant, the section has a cross-section substantially in the shape of a "V" which is inverted on the foundations of the industrial floor, this being so that the projecting angle of the "V" is directed towards the upper surface of the base.

According to a second advantageous variant, the section has a cross-section substantially in the shape of a "T" which is inverted on the foundations of the industrial floor, this being so that the vertical bar of the "T" is arranged vertically and directed towards the upper surface of the base.

More preferably, according to a third advantageous variant, the section has a cross-section substantially in the shape of a "Y" which is arranged stably on the foundations of the industrial floor, so that one of the branches of the "Y" is arranged vertically and directed towards the upper surface of the base.

As indicated above, once the profiled crack inducers are laid, and preferably fastened on the foundations of the industrial floor using a suitable fastening means such as nails, the concrete is poured in order to form the base, then, as soon as the base has reached sufficient mechanical strength, the surface of the concrete is smoothed, advantageously by covering it with at least one smoothing layer; then the smoothed surface is successively covered with at least one separating means, a reinforcement in the form of a lattice, then at least one layer to form the covering.

ADVANTAGES OF THE INVENTION

Surprisingly, the invention makes it possible to give this thin covering, which is not bound to the concrete base, industrial-level mechanical performance, which is consequently greatly superior to that encountered in the case of known residential and pedestrian floors, and thus to transfer all the advantages of this covering construction technique to industrial contexts.

The advantages of the invention are therefore as follows:

1. the interruption in the transmission of random cracks from the base to the surface of the covering.
2. the bridging of the shrinkage joints of the base by the covering, without damage to the latter, on condition that these joints are properly designed, that is to say that the amplitude of their movements is predictable and limited. In the case of new industrial floors, the technique of inducing shrinkage cracks by sections is combined with the floor manufacturing technique recommended in the present invention. This results in the possibility of producing industrial floors without random cracks, with greatly increased spacings between joints the spacing between, be noted that the spacing between the joints depends, as for the base amongst other things, on the working conditions of the floor, the loads in place and the thermal and hygrometric variations of the surroundings. In the case when these constraints are normal (i.e. variations in the degree of hygrometry of the order of 40% and thermal variations less than 30° C.), surface areas of more than 1000 $m^2$ without joints may be envisaged. In contrast to the sawing technique, the invention, with the advantageous variants using the smoothing layer and the crack inducer sections, allows a considerable acceleration in the rate of production of the concrete base. Rates of more than 2000 $m^2$/day are thus easily achieved.
3. for renovation, it is essential to have added (over) thicknesses which are as small as possible compared to the original level (in particular because of the creation of slopes, the level of the machine installation station, the available roof height, etc.). The invention, which respects the abovementioned conditions, is therefore suitable for the renovation of industrial floors.
4. ease of repair: the main difficulty encountered in current techniques resides in the removal of the spoiled adhesive screed. The invention makes it possible to remove it rapidly, with very fast mechanical means and minimal interference (noise, dust, vibrations, occupation of premises, equipment, etc.).
5. furthermore, the development of the technique is such that, in order to give the best response to constraints of flatness, finishing and floor performance in general, in particular industrial floors, there is a current requirement to deposit a finishing layer with the distinctive characteristics of the concrete of the base. This floor manufacturing technique is therefore advantageously reconciled with this technological trend.

INDUSTRIAL APPLICATIONS

Because of the advantages listed above, the invention is particularly suitable for industrial floors intended, for example, for car parks, industrial or commercial buildings and, more particularly, for:

industries in which the presence of joints causes problems (agro-foodstuff);

or alternatively when the long-term stability of the floors cannot but be limited because of the activities carried out (heavy engineering, chemical industries, agro-foodstuff, cold rooms, iron and steel, etc.)

The invention is furthermore suitable for the production of residential and pedestrian floors (for example, those in hospital or school buildings).

The invention is now illustrated by way of two particular embodiments.

EXAMPLES

Manufacture of a 200 $m^2$ unjointed industrial floor in industrial premises used for storage and delivery frequently of loads of 7 tonnes per $m^2$ (stacked pallets), in cold weather with variations of from 0° to 7° C.

The foundations

The foundations of the industrial floor are a standard layer made from a mixture of rough quarry granulates, and the foundations furthermore comprise a roller-compacted insulating plastic sheet under the foundations.

The concrete base

It is made of non-reinforced concrete and is 17 cm high. Sections commercialised by the company MIERS under the brand name "CONCRACK" are placed every 5 meters on the foundations in order to form a grid with "meshes" of 25 $m^2$ surface area: these sections, which have a "Y" cross-section shape, have a height of 50 mm and are made from rigid polypropylene. The "CONCRACK" sections are fixed on the foundations using nails. The location of the sections is accurately determined.

The concrete is then introduced with a railless manual rule. The poured concrete comprises:

sand: 820 kg/$m^3$, including 191 kg/$m^3$ of fine sand;

gravel: 938 kg/$m^3$;

hydraulic binder (Portland cement CPA 55): 370 kg/$m^3$;

mixing water: 197 ±7 kg/$m^3$;

a fluidifier: 0.25% of the weight of hydraulic binder.

Such a concrete guarantees a 35 MPa characteristic strength at 28 days according to Standard NF P 18305.

The concrete is quick-setting. It is in fact possible to walk on the concrete ten hours after pouring.

The temperature varied from 3° to 5° C. during the preparation of the base.

An adhesion primer is then applied over the entire area of the base, in a single layer. This primer consists of an aqueous-phase dispersion of vinyl copolymers. This primer is left to dry for two hours. Consumption is of the order of 200 g per $m^2$ of surface area.

The smoothing layer is then applied onto the upper face of the base, in order to make it smooth and to eliminate all possible retention points therefrom. The product applied is a smoothing coating essentially based on cement, commercialised by the company OMNIPLASTIC under the brand name OMNIPLAN. This coating is chosen because of the level of its mechanical characteristics, which allow it to withstand the indirect load of industrial mechanical stresses.

This product is applied quickly using the application pump of brand name SERVAPLAN, described in European Patent Application No. 92420025.6, with a mean thickness of 3 to 4 mm.

The smoothing product is then left to harden for 24 hours, this time being sufficient for it to be able to withstand foot traffic.

The smoothing layer is then covered with a viscous liquid product, which makes it possible to avoid adhesion between the wear layer and the smoothing layer. This product creates a strong, leaktight and completely non-adhesive film. It consists of petroleum derivatives in aqueous dispersion, commercialised under the brand name ELVECURE by the company CHRYSO. The consumption of this product is 150 grams per $m^2$. This product is left to dry for 4 hours, to make it able to withstand being walked on by a person.

After 4 hours, small elements, making it possible to support the lattice, are distributed at regular intervals, spaced apart by approximately 40 cm, on the separating means. This lattice is a galvanized metal lattice with a mesh size of 10 mm×10 mm and a wire diameter of 1 mm. This lattice is rolled out over the entire area to be treated.

The covering or wear layer 2 cm of a covering intended to form the wear layer is then poured. To do this, use is made of the automatic SERVAPLAN pump. Application takes approximately 2 hours.

The coating used to form the wear layer is composed of:

Portland cement: 18% to 25% alumina cement: 1% to 10% fillers: 5% to 25% silica sands: 35% to 65% organic binder: 0.5% to 5% fluidifier: 0.05% to 1% setting regulator: 0.01% to 0.3%

Other components may be added to this formulation, with a view to improving the characteristics and performance of the coating (colorants, hardeners, retarders, etc.).

The covering is left as it is for 18 hours, then a liquid product making it possible to inhibit the evaporation of water from the hydraulic covering, and thereby prevent it from cracking prematurely, is applied. This product, called a curing agent, is specially designed to allow the subsequent application of any other aesthetic coverings: paints, textiles, plastics or the like.

The floor is left free of traffic for 48 hours, then returned to heavy use within 5 days without any damage: storage of 1.2 tonne pallets on 5 levels, handling by lifter trucks with solid-tire wheels.

No cracking occurred anywhere 28 days after pouring.

Another building site example: manufacture of a 150 $m^2$ unjointed renovated industrial floor in cold weather with variations of from +1° C. to +15° C.

The base

The base of the wear layer is dry, aged concrete with suitable characteristics, with proper cohesion but containing irregularly distributed cracks.

The whole is stabilized.

Preparation of the base

All of the old concrete is cleaned then carefully vacuumed in order to remove any non-adhering part and to make the surface uniform.

An adhesion primer is then applied over the entire area, in a single layer. This primer consists of an aqueous-phase dispersion of vinyl copolymers.

This primer is left to dry for two hours. Consumption is of the order of 200 g per $m^2$ of surface area.

The smoothing layer is then applied onto the upper face of the base, in order to make it smooth and to eliminate all possible retention points therefrom. The product applied is a smoothing coating essentially based on cement, commercialised by the company OMNIPLASTIC under the brand name OMNIPLAN. This coating is chosen because of the level of its mechanical characteristics, which allow it to withstand the indirect load of industrial mechanical stresses.

This product is applied quickly using the application pump of brand name SERVAPLAN, described in European Patent Application No. 92420025.6, with a mean thickness of 3 to 4 mm.

The smoothing product is then left to harden for 24 hours, this time being sufficient for it to be able to withstand foot traffic.

The smoothing layer is then covered with a viscous liquid product, which makes it possible to avoid adhesion between the wear layer and the smoothing layer. This product creates a strong, leaktight and completely non-adhesive film. It consists of petroleum derivatives in aqueous dispersion, commercialised under the brand name ELVECURE by the company CHRYSO. The consumption of this product is 150 grams per $m^2$.

This product is left to dry for 4 hours, to make it able to withstand being walked on by a person.

After 4 hours, small elements, making it possible to support the lattice, are distributed at regular intervals, spaced apart by approximately 40 cm, on the separating means. The lattice is a glass lattice with a mesh size of 1 cm. This lattice is rolled out over the entire area to be treated. This self-adhesive lattice adheres locally to the floor and is thus prevented from accidentally rising.

The covering or wear layer 2 cm of a covering intended to form the wear layer is then poured. To do this, use is made of the automatic SERVAPLAN pump. Application takes approximately 2 hours.

The coating used to form the wear layer is composed of:

Portland cement: 18% to 25% alumina cement: 1% to 10% fillers: 5% to 25% silica sands: 35% to 65% organic binder: 0.5% to 5% fluidifier: 0.05% to 1% setting regulator: 0.01% to 0.3%

Other components may be added to this formulation, with a view to improving the characteristics and performance of the coating (colorants, hardeners, retarders, etc.).

The covering is left as it is for 18 hours, then a liquid product making it possible to inhibit the evaporation of water from the hydraulic covering, and thereby prevent it from cracking prematurely, is applied. This product, called a curing agent, is specially designed to allow the subsequent application of any other aesthetic coverings: paints, textiles, plastics or the like.

The floor is left free of traffic for 48 hours, then returned to heavy use within 5 days without any damage: storage of 1 tonne electric motors, handling by lifter trucks with solid-tyre wheels.

No cracking occurred anywhere 28 days after pouring.

We claim:

1. An industrial, floor comprising at least one covering layer on a new or existing concrete base having an upper face and a lower face, said covering layer being not bound to the concrete base and obtained from a composition based on at least one hydraulic binder, said floor further comprising, between the concrete base and the covering layer, from the upper face of the concrete base:

(a) a smoothing layer enabling the flatness/roughness of said upper face to be less than 2 mm under a 2 meter rule;

(b) on the smoothing layer, at least one separating layer for preventing the covering layer from adhering to the smoothing layer on the base;

(c) on the separating layer, at least one covering layer having a maximum thickness of 30 mm.

2. A floor according to claim 1, characterized in that the concrete base has a compressive strength on the order of at least 10 MPa, and a flexural/tensile strength is on the order of at least 2.2 MPa and the covering has a tear strength on the order of 1–2 MPa.

3. A floor according to claim 2, wherein the compressive strength is at least equal to 20 MPa and the flexural/tensile strength is at least equal to 2.5 MPa.

4. A floor according to claim 1, characterized in that the smoothing layer is produced by means of a material which, once hardened, has a minimum compressive strength of the order of 10 MPa.

5. A floor according to claim 4, wherein the minimum compressive strength is 20 MPa.

6. A floor according to claim 4, wherein said smoothing layer comprises cement, the separating layer comprises a member selected from the group consisting of paraffins, silicones, petroleum-based waxes, magnesium stearates, and a polyolefinic film, and the covering layer comprises at least one hydraulic binder and at least one organic binder.

7. A floor according to claim 6, further comprising a bonding primer intermediate the base and the smoothing layer, said bonding primer comprising an impregnation product of a resin, said bonding layer bonding the smoothing layer to the base.

8. A floor according to claim 1, characterized in that the thickness of the smoothing layer is of the order of at least 3 mm.

9. A floor according to claim 1, characterized in that the separating layer has a thickness on the order of 100 $\mu$m to 200 $\mu$m.

10. A floor according to claim 1, characterized in that the separating layer has a thickness of at least 3 mm, on condition that the material used withstands, without deforming, the pressure of a screed in use.

11. A floor according to one of claim 1, characterized in that the covering layer is a composition comprising at least one hydraulic binder and at least one organic binder.

12. A floor according to claim 1, wherein intermediate the base and the smoothing layer is a bonding primer comprising a layer of an impregnation product in order to improve the adherence, to control the porosity of the concrete base and, optionally, to prevent the appearance of surface chalking.

13. A floor according to claim 1 further comprising at least one section defining a cross-section having a height, said at least one section being arranged on a foundation which supports said floor, said height of said at least one section being is less than a height of a cross-section of said base, and wherein said base is formed by pouring concrete over said foundation and said at least one section.

14. A floor according to claim 13, wherein the concrete base has an upper surface and as characterized in that at least one of said sections has a cross-section substantially in the shape of an inverted "V" on the foundations of the floor.

15. A floor according to claim 13, wherein the concrete base has an upper surface and is characterized in that at least one of said sections has a cross-section substantially in the shape of an inverted "T".

16. A floor according to claim 13, wherein the concrete base has an upper surface and is characterized in that at least one of said sections has a cross-section substantially in the shape of an inverted "Y".

17. A floor according to claim 13, characterized in that sections are spaced apart from one another by a distance ranging approximately from 1 metre to 10 metres.

18. A floor according to claim 17, wherein said distance is at least 5 metres.

19. A floor according to claim 13, characterized in that the height of the section is at least equal to ⅙ of the height of the concrete base.

20. A floor according to claim 19, wherein the height of the section is at least equal to ⅓ of said height of said base.

21. A floor according to claim 19, wherein the height of the section is at least equal to ½ of said height of said base.

22. A floor according to claim 1, wherein the separating layer withstands, without deforming, the pressure of a screed in use.

* * * * *

UNITED STATES PATENT AND TRADEMARK OFFICE
CERTIFICATE OF CORRECTION

Patent No.: 5,848,504

Dated: December 15, 1998

Inventor(s): Jean-Paul Guerinet, Hervé Nouailhetas

It is certified that error appears in the above-identified patent and that said Letters Patent is hereby corrected as shown below:

In claim 1, line 14, after "1" insert -- reinforced --.

In claim 11, line 1, delete "one of".

In claim 13, line 5, delete "is".

In claim 14, line 2, delete "as" and insert --is--.

Signed and Sealed this

Tenth Day of August, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,848,504

DATED : December 15, 1998

INVENTOR(S) : Jean-Paul Guerinet, et. al.

It is certified that error appears in the above-identified patent and that said Letters Patent is hereby corrected as shown below:

In claim 1, line 14, after "one" insert -- reinforced --.

Signed and Sealed this

Twenty-first Day of September, 1999

*Attest:*

Q. TODD DICKINSON

*Attesting Officer*

*Acting Commissioner of Patents and Trademarks*